US007599783B2

(12) United States Patent
Nakane

(10) Patent No.: US 7,599,783 B2
(45) Date of Patent: Oct. 6, 2009

(54) INJECTION QUANTITY CONTROL UNIT AND FUEL INJECTION SYSTEM HAVING THE UNIT

(75) Inventor: Noriaki Nakane, Komaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/081,377

(22) Filed: Apr. 15, 2008

(65) Prior Publication Data

US 2008/0319637 A1 Dec. 25, 2008

(30) Foreign Application Priority Data

Jun. 20, 2007 (JP) ..... 2007-162718

(51) Int. Cl.
*F02D 41/16* (2006.01)

(52) U.S. Cl. ..... 701/104; 123/436

(58) Field of Classification Search ..... 701/104; 123/436

See application file for complete search history.

(56) References Cited

U.S. PATENT DOCUMENTS

| | | | | |
|---|---|---|---|---|
| 4,535,406 | A | 8/1985 | Johnson | |
| 5,241,480 | A * | 8/1993 | Takaku et al. | 701/111 |
| 6,672,284 | B2 * | 1/2004 | Majima | 123/436 |
| 6,755,176 | B2 | 6/2004 | Takeuchi et al. | |
| 6,892,702 | B2 * | 5/2005 | Isoda et al. | 123/406.24 |
| 7,317,983 | B2 | 1/2008 | Ishizuka et al. | |
| 7,319,930 | B2 * | 1/2008 | Dietl et al. | 701/104 |
| 7,448,360 | B2 * | 11/2008 | Kita | 123/436 |
| 7,536,902 | B2 * | 5/2009 | Tsukamoto et al. | 73/114.04 |
| 2002/0043247 | A1 * | 4/2002 | Majima | 123/436 |
| 2006/0293828 | A1 * | 12/2006 | Ishizuka et al. | 701/105 |
| 2007/0144492 | A1 * | 6/2007 | Sugiyama et al. | 123/480 |

FOREIGN PATENT DOCUMENTS

JP 3591428 9/2004

OTHER PUBLICATIONS

Japanese Office Action dated Apr. 21, 2009, issued in counterpart Japanese Application No. 2007-162718, with English translation.

* cited by examiner

*Primary Examiner*—Erick Solis
(74) *Attorney, Agent, or Firm*—Nixon & Vanderhye, PC

(57) ABSTRACT

An injection quantity control unit controls an injection quantity of a plurality of fuel injection valves, respectively. The unit includes a rotational speed obtaining device for obtaining a rotational speed of the engine, an integration value calculating device for calculating an integration value of the rotational speed, which is equal to or more than a predetermined rotational speed, in an explosion stroke of each of the cylinders, and a correcting device for correcting the injection quantity of the plurality of fuel injection valves based on the integration value of each of the cylinders so as to reduce variation in a rotational speed variation among the cylinders.

6 Claims, 3 Drawing Sheets

INJECTION QUANTITY CONTROL UNIT AND FUEL INJECTION SYSTEM HAVING THE UNIT

CROSS REFERENCE TO RELATED APPLICATION

This application is based on and incorporates herein by reference Japanese Patent Application No. 2007-162718 filed on Jun. 20, 2007.

BACKGROUND OF THE INVENTION

1. Field of the Invention

The present invention relates to an injection quantity control unit that controls injection quantities of fuel injection valves, which inject fuel into corresponding cylinders of a multi-cylinder internal combustion engine, and a fuel injection system having the unit.

2. Description of Related Art

Conventionally, in a fuel injection system, in which fuel is injected into each cylinder of a multi cylinder internal combustion engine by corresponding one of fuel injection valves, a variation amount of a rotational speed in an explosion stroke varies among the cylinders because of the variation in injection quantity of the fuel injection valve due to, for example, manufacturing errors in manufacturing the valves. Accordingly, engine vibration may be generated due to variation in the rotational speed variations. For example, when the rotational speed variations of the cylinders vary in an idle operational state and thereby the engine vibration is generated, the engine vibration may cause discomfort to a vehicle occupant.

In order to reduce such variation in the rotational speed variations among the cylinders, an inter-cylinder injection quantity correction, whereby the injection quantities of the fuel injection valves which inject fuel are corrected for respective cylinders, is known (see, e.g., JP3591428B2). In the conventional inter-cylinder injection quantity correction in JP3591428B2, the injection quantity of the fuel injection valve is corrected based on the rotational speed variation in the explosion stroke of each cylinder, to reduce the variation in the rotational speed variations among the cylinders. For example, in a cylinder with a large rotational speed variation, the injection quantity of the fuel injection valve is reduced, and in a cylinder with a small rotational speed variation, the injection quantity of the fuel injection valve is increased.

However, the rotational speed variation, which is a difference between the maximal value of the rotational speed in the explosion stroke of each cylinder and the minimum valve of the rotational speed at the start of the explosion stroke, is influenced not only by the injection quantity of fuel injected into each cylinder in the explosion stroke but also by the rotational speed variation of an immediately preceding cylinder which performs the explosion stroke immediately before each cylinder.

Each cylinder tends to rotate an internal combustion engine against the moment of inertia of a piston in the immediately preceding cylinder at the start of the explosion stroke. As a result, if the fuel injection quantity is the same, when the rotational speed variation of the immediately preceding cylinder is small and the moment of inertia of the immediately preceding cylinder becomes small, the rotational speed variation of each cylinder becomes large, and conversely, when the rotational speed variation of the immediately preceding cylinder is large and the moment of inertia of the immediately preceding cylinder becomes large, the rotational speed variation of each cylinder becomes small.

When the injection quantity is corrected in the above manner based on the rotational speed variation of each cylinder increased or decreased because of the influence of the rotational speed variation of the immediately preceding cylinder, the injection quantity cannot be corrected with high precision to reduce the variation in the rotational speed variations among the cylinders. Consequently, when the variation in the rotational speed variations among the cylinders is especially large, a period taken to reduce the variation in the rotational speed variations becomes long.

SUMMARY OF THE INVENTION

The present invention addresses the above disadvantages. Thus, it is an objective of the present invention to provide an injection quantity control unit, which corrects with high precision injection quantities of fuel injection valves for injecting fuel into corresponding cylinders of an internal combustion engine to promptly reduce variation in rotational speed variations among the cylinders, and a fuel injection system having the unit.

To achieve the objective of the present invention, there is provided an injection quantity control unit for controlling an injection quantity of a plurality of fuel injection valves, respectively. Each of the plurality of fuel injection valves injects fuel into a corresponding one of cylinders of a multi-cylinder internal combustion engine. The unit includes a rotational speed obtaining means, an integration value calculating means, and a correcting means. The rotational speed obtaining means is for obtaining a rotational speed of the engine. The integration value calculating means is for calculating an integration value of the rotational speed, which is equal to or more than a predetermined rotational speed, in an explosion stroke of each of the cylinders. The correcting means is for correcting the injection quantity of the plurality of fuel injection valves based on the integration value of each of the cylinders so as to reduce variation in a rotational speed variation among the cylinders. The rotational speed variation is a difference between a maximum rotational speed in the explosion stroke of each of the cylinders and a minimum rotational speed at a starting time of the explosion stroke of each of the cylinders.

To achieve the objective of the present invention, there is also provided a fuel injection system including a high pressure pump, a common rail, a plurality of fuel injection valves, and the injection quantity control unit. The high pressure pump pressurizes and force-feeds fuel. The common rail accumulates fuel, which is force-fed by the high pressure pump. Each of the plurality of fuel injection valves injects fuel, which is accumulated by the common rail, into a corresponding one of cylinders of a multi-cylinder internal combustion engine.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Embodiments of the invention are described below with reference to the accompanying drawings.

(Fuel Injection System 10)

Figure 1:
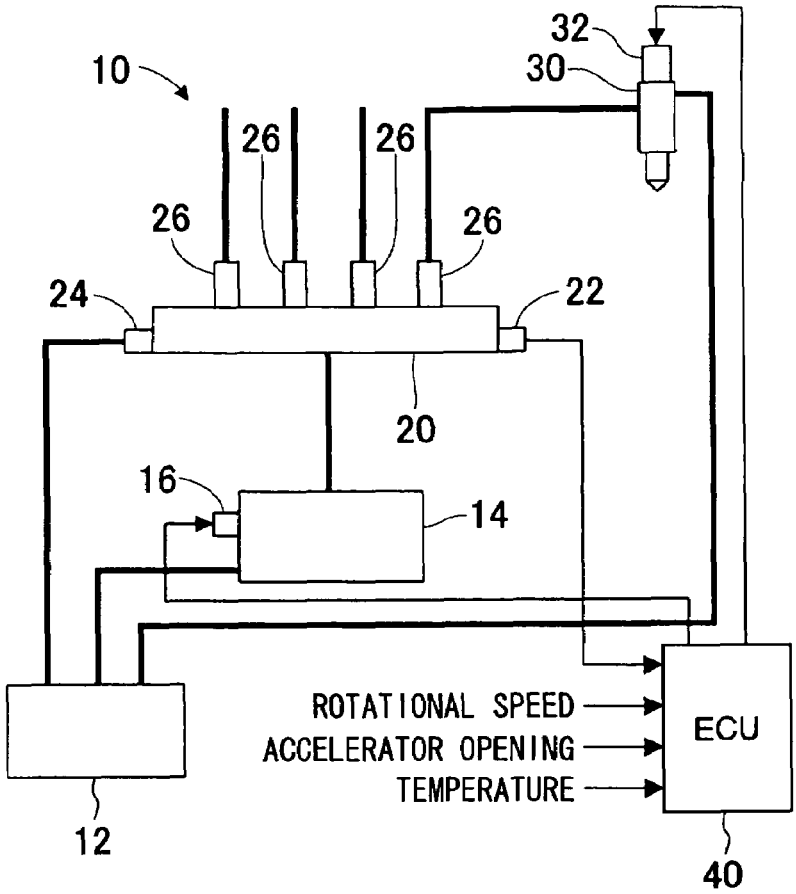
FIG. 1 is a schematic view illustrating a configuration of a fuel injection system according to an embodiment of the invention.

An embodiment of a fuel injection system of the invention is shown in FIG. 1. An accumulator fuel injection system 10 includes a fuel tank 12, a high pressure pump 14, a common rail 20, a fuel injection valve 30, and an electronic control unit (ECU) 40.

The high pressure pump 14 as a fuel feed pump is a publicly known pump which pressurizes fuel suction into a pressurizing chamber as a result of the reciprocation movement of a plunger according to rotation of a cam of the cam shaft rotated with a crankshaft of a diesel engine. An amount of fuel suctioned into the pressurizing chamber by the high pressure pump 14 is controlled by a regulating valve 16 disposed on a fuel inlet side of the high pressure pump 14. The regulating valve 16 is an electromagnetic valve, which varies a suction opening area due to the movement of a valve member according to a current value supplied to an electromagnetic driving unit. By regulating the amount of suctioned fuel into the pressurizing chamber, an amount of fuel which the high pressure pump 14 feeds is controlled.

The common rail 20 accumulates fuel which the high pressure pump 14 feeds. Fuel pressure is held to a predetermined high pressure according to an engine operation condition. A pressure sensor 22 as a pressure detecting means detects a common rail pressure inside the common rail 20 and outputs the common rail pressure to the ECU 40.

A pressure limiter 24 is a valve which is opened when the common rail pressure exceeds a predetermined pressure to hold the common rail pressure to the predetermined pressure or below. Flow dampers 26 are arranged on an output side of the common rail 20 for reducing pulsations in the common rail 20 or in a pipe connecting the flow damper 26 and the fuel injection valve 30.

The fuel injection valve 30 is disposed in each cylinder of, for example, a four-cylinder diesel engine to inject fuel which the common rail 20 accumulates into the cylinder. The fuel injection valve 30 is a publicly known electromagnetically-driven injector which controls fuel injection quantity by controlling a communicative connection between a control chamber which applies fuel pressure to a nozzle needle in a valve closing direction and a low-pressure side by an electromagnetic driving unit 32.

The ECU 40 as an injection quantity control unit includes a microcomputer mainly having a central processing unit (CPU), a read-only memory (ROM), a random access memory (RAM), and a flash memory. A control program which carries out an inter-cylinder injection quantity correction is stored in the ROM or the flash memory. The control program makes the ECU 40 function as a rotational speed obtaining means, an integration value calculating means, a correcting means, a rotational speed variation calculating means, a difference calculating means, and a determining means. The ECU 40 stores an injection quantity characteristics map showing a relationship between a pulse width of an injection command signal, which commands the fuel injection valve 30 to inject fuel, and the injection quantity in a storage unit such as a flash memory. The ECU 40 calculates the pulse width of the injection command signal corresponding to a target injection quantity based on the injection quantity characteristics map, to control the injection quantity of the fuel injection valve 30.

The ECU 40 detects an operational state of the diesel engine based on detecting signals of various sensors such as a rotational speed sensor which detects an engine rotational speed (NE), an accelerator sensor which detects a degree of opening of an accelerator pedal (ACC), a crank angle sensor which detects a crank angle (CA), a temperature sensor which detects a water temperature (Temp), and a pressure sensor 22 which detects a common rail pressure (PC). The ECU 40 controls the regulating valve 16 of the high pressure pump 14, the electromagnetic driving unit 32 of the fuel injection valve 30, and the like, in order to control the diesel engine to have an optimal operating condition.

(Injection Quantity Correction)

Figure 2:
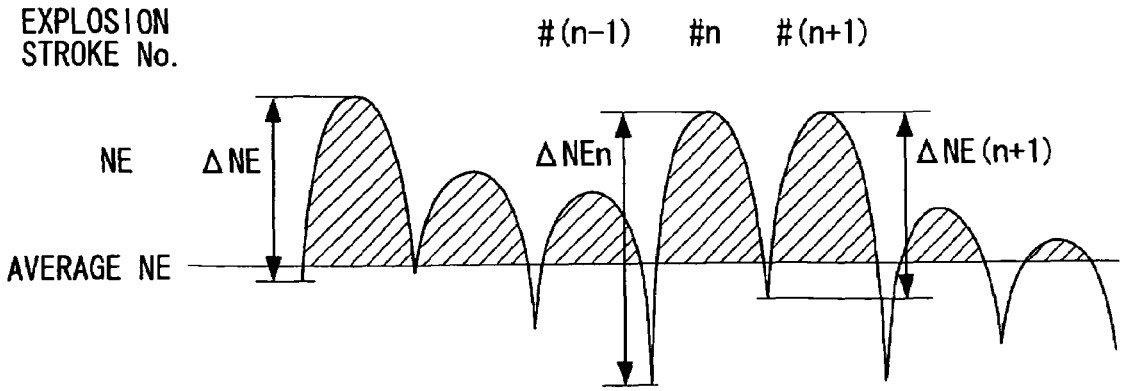
FIG. 2 is a graph illustrating characteristics of a rotational speed variation in an explosion stroke of each cylinder according to the embodiment.

Injection quantity correction in the fuel injection system 10 is explained. FIG. 2 shows a change of a rotational speed NE when cylinders of a four-cylinder diesel engine carry out an explosion stroke one by one. In FIG. 2, a rotational speed variation ΔNE expresses a difference between a maximum rotational speed in the explosion stroke of each cylinder and a minimum rotational speed at the start of the explosion stroke.

Figure 3:
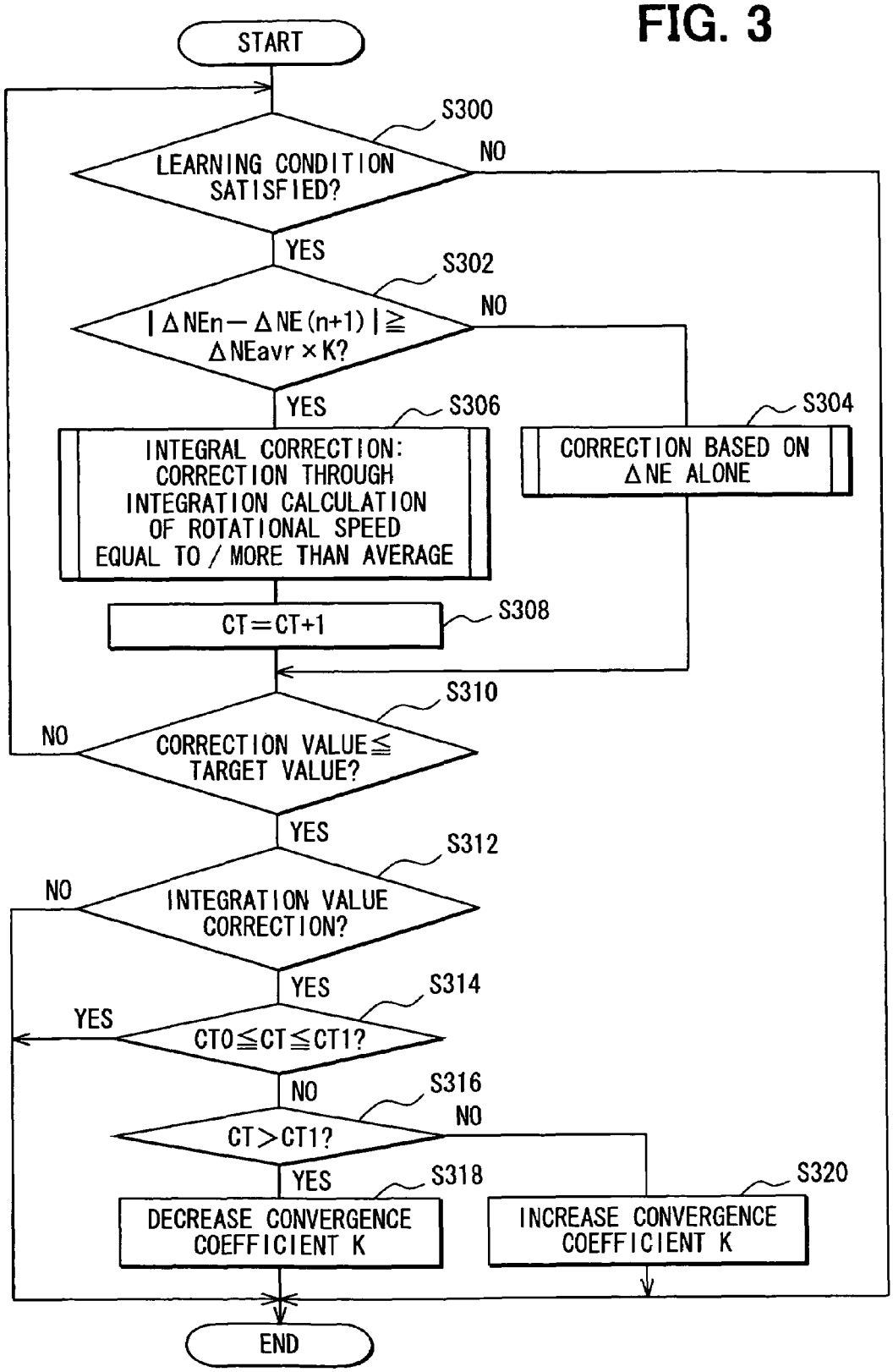
FIG. 3 is a flowchart illustrating an injection quantity correction routine according to the embodiment.

An injection quantity correction routine shown in FIG. 3 reduces variation in rotational speed variations between a plurality of cylinders shown in FIG. 2. The ECU 40 performs the injection quantity correction routine in FIG. 3 once at the start of engine starting. The injection quantity correction is not performed each time at the start of the engine starting. Instead, the correction is carried out about one time every several engine startings when a travel distance is equal to or larger than a predetermined distance and thereby a variation in the injection quantity of the fuel injection valve 30 is small. It is desirable to decrease a frequency of performing of the correction.

Figure 4:
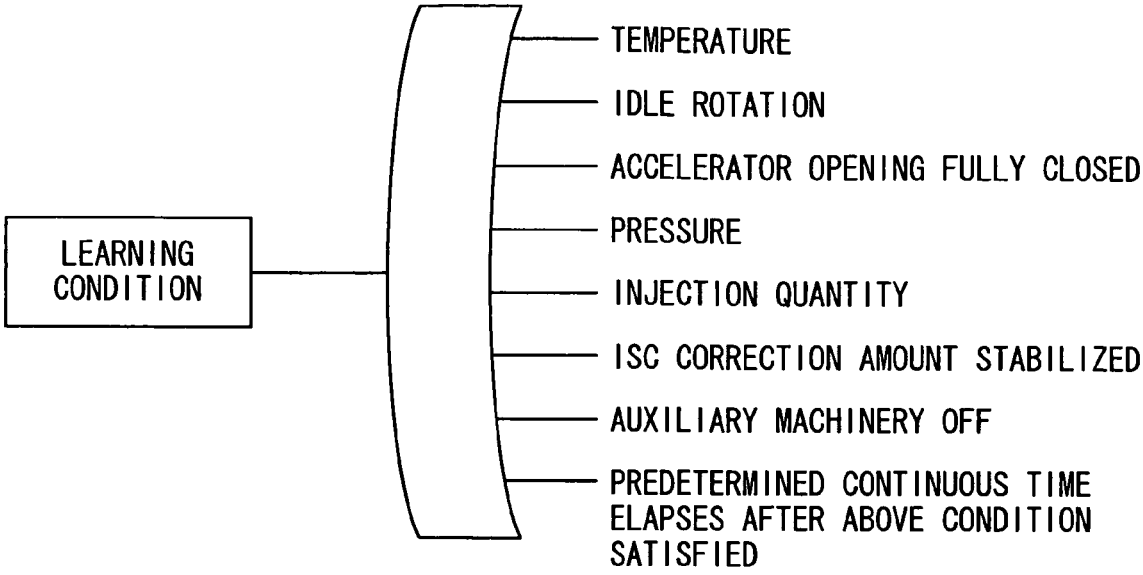
FIG. 4 is an illustration diagram illustrating learning satisfaction conditions for injection quantity correction according to the embodiment.

At S300 in FIG. 3, the ECU 40 determines whether learning conditions of the injection quantity correction are satisfied. FIG. 4 illustrates the conditions for carrying out the injection quantity correction learning. The injection quantity correction learning is carried out when disturbances which fluctuate a rotational speed are as small as possible. When all the following conditions are satisfied, For example, the injection quantity correction learning is carried out.

- Fuel temperature, common rail pressure, and injection quantity are within a predetermined range.
- Idle operational state
- Accelerator-off
- A correction amount of idol speed control (ISC) is stable.
- Auxiliary machinery such as an air-conditioning system is turned off.
- The above conditions continue for a predetermined time or longer.

If the learning conditions of the injection quantity correction are not satisfied at S300, the ECU40 ends the routine. If the learning conditions of the injection quantity correction are satisfied, the ECU 40 determines whether the following formula (1) is satisfied at S302.

$$|\Delta NEn-\Delta NE(n+1)|\geqq\Delta NEavr\times K \quad (1)$$

In the formula (1), ΔNEn is a rotational speed variation of a cylinder which first carries out an explosion stroke of #n among the cylinders in which the explosion stroke is sequentially performed (FIG. 2). ΔNE(n+1) is a rotational speed variation of a cylinder which next carries out an explosion stroke of #(n+1) (FIG. 2). ΔNEavr is an average value of the rotational speed variations of the cylinders. K (0<K<=1) is a convergence coefficient.

The ECU 40 obtains the rotational speed of each cylinder based on the detecting signal of the rotational speed sensor, and computes the rotational speed variation of each cylinder based on the obtained rotational speed. Based on the computed rotational speed variation of each cylinder, a difference between rotational speed variations of the cylinders in which the explosion stroke is sequentially performed is computed.

K is set at, for example, 0.5 as its initial value. In other words, the formula (1) expresses that the difference between rotational speed variations of the cylinders in which the explosion stroke is sequentially performed is equal to or larger than half (in the case of K=0.5) of an average rotational speed variation ΔNEavr. By making (ΔNEavr×K) a predetermined value in the formula (1), the predetermined value, which is compared to the difference between the rotational speed variations, is easily set by the convergence coefficient K with the average rotational speed variation ΔNEavr being a reference value.

The ECU 40 calculates at least once rotational speed variations of all the cylinders in which the explosion stroke is sequentially performed. Then, the ECU 40 determines whether at least one of the differences between the calculated rotational speed variations satisfies the formula (1).

If the formula (1) is not satisfied at S302, it is determined that the difference of the rotational speed variations between the cylinders is small. Then, the ECU 40 carries out the injection quantity correction based on the conventional rotational speed variation of each cylinder at S304. After the injection quantity correction at S304, control of the ECU 40 proceeds to S310.

If the formula (1) is satisfied at S302, the ECU 40 integrates the rotational speed of each cylinder, which is equal to or more than an average rotational speed as a predetermined rotational speed at S306. An integration value for each cylinder is an area of the rotational speed of each cylinder equal to or more than the average rotational speed, which is indicated by a shaded area in FIG. 2. The ECU 40 corrects the injection quantity based on the integration value for each cylinder computed at S306. The ECU 40 corrects the injection quantity by adjusting the pulse width of the injection command signal. For example, the ECU 40 reduces the injection quantity of the fuel injection valve for a cylinder with a large integration value. The ECU 40 increases the injection quantity of the fuel injection valve for a cylinder with a small integration value.

The reason why the injection quantity correction is carried out based on the integration value of the shaded area in FIG. 2 is explained below. Even though the injection quantity for a cylinder of #n in FIG. 2 is the same, the rotational speed variation of the cylinder of #n varies according to the size of the rotational speed variation of a cylinder corresponding to the #(n−1) explosion stroke. When the rotational speed variation of the cylinder of #(n−1) becomes small, the rotational speed variation of the cylinder for #n becomes large. When the rotational speed variation of the cylinder of #(n−1) becomes large, the rotational speed variation of the cylinder of #n becomes small.

This is because a piston is depressed in the explosion stroke of the following cylinder against the moment of inertia of a piston in the immediately preceding cylinder, which is depressed in the explosion stroke of the immediately preceding cylinder, and thereby the diesel engine is rotated. When the rotational speed variation of the immediately preceding cylinder is small and the moment of inertia becomes small, the rotational speed variation of the following cylinder becomes large. Conversely, when the rotational speed variation of the immediately preceding cylinder is large and the moment of inertia becomes large, the rotational speed variation of the following cylinder becomes small.

In the above manner, even if the same injection quantity of fuel is injected, the rotational speed variation of the following cylinder varies according to the rotational speed variations of the immediately preceding cylinder. Accordingly, when the injection quantity correction is carried out based on the rotational speed variation of the cylinder in the conventional manner, accuracy of the injection quantity correction becomes low. As a result, when variation in the rotational speed variations among the cylinders is especially large, a convergence time taken to reduce the variation in the rotational speed variations among the cylinders within a predetermined range becomes longer.

In the explosion stroke of the following cylinder, when the diesel engine is rotated to increase its rotational speed against the moment of inertia of the immediately preceding cylinder, and the average rotational speed which is the predetermined rotational speed is reached, the rotational speed variation thereafter is not influenced by the moment of inertia of the immediately preceding cylinder, and is determined by the amount of work which the following cylinder carries out in the explosion stroke.

More specifically, the integration value of the rotational speed equal to or more than the average rotational speed in the explosion stroke of each cylinder is not influenced by the rotational speed variation of the immediately preceding cylinder. The above integration value is regarded as an effective amount of work which each cylinder performs when fuel injected by the fuel injection valve 30 in the explosion stroke is combusted. Consequently, since the variation in the rotational speed variations among the cylinders is reduced based on the computed integration value, the injection quantity of the fuel injection valve 30 is corrected with high precision. As a result, the variation in the rotational speed variations among the cylinders is promptly reduced.

If the predetermined rotational speed serving as the boundary value when computing the integration value is too small, the integration calculation is performed, with the range of the rotational speed at the start of the explosion stroke of each cylinder that is greatly influenced by the rotational speed variation of the immediately preceding cylinder being included in its integration range. As a result, the injection quantity of the fuel injection valve 30 cannot be corrected with high precision despite the correction based on the integration value.

On the other hand, if the predetermined rotational speed serving as the boundary value is too large, the maximum rotational speed does not reach the predetermined rotational speed, and thereby the rotational speed cannot be integrated in some cylinders. Moreover, since the calculated integration value is small, calculation accuracy in calculating the integration value decreases.

By setting the predetermined rotational speed that is a boundary value when computing the integration value to be the average rotational speed, removing the influence of rotation of the immediately preceding cylinder as much as possible. Also, the existence of a cylinder for which the integration calculation cannot be performed on the rotational speed because the maximum rotational speed does not reach the predetermined rotational speed is prevented, and the value of the calculated integration value is made as large as possible. Accordingly, the calculation accuracy of the integration value improves, and thereby the correction accuracy of the injection quantity of the fuel injection valve 30, which is corrected based on the integration value, is improved.

If the formula (1) is not satisfied at S302, the difference of the rotational speed variations between the immediately preceding cylinder and the following cylinder is small. Thus, even though the conventional injection quantity correction based on the rotational speed variation is performed at S304, the convergence time does not become long.

After the injection quantity correction is carried out based on the computed integration value at S306, the ECU 40 adds +1 to a counter CT at S308. When performing the injection quantity correction routine in FIG. 3, the counter CT is set at, for example, 0 (zero) as an initial value.

At S310, the ECU 40 determines whether the correction value for the injection quantity of each cylinder computed at S304 or S306 is equal to or smaller than a target value. If the correction value of the injection quantity for each cylinder is equal to or smaller than the target value, it is determined that the correction value of the injection quantity becomes small and thus the variation in the rotational speed variations among the cylinders has been reduced. Then, control proceeds to S312.

If the correction value of the injection quantity for each cylinder is larger than the target value, it is determined that the correction value of the injection quantity is large and thus the variation in the rotational speed variations among the cylinders has not been reduced within the predetermined range. Then, control of the ECU 40 returns to S300.

At S312, the ECU 40 determines whether the present injection quantity correction is the integration value correction. If the present correction is not the integration value correction but the conventional correction based on the rotational speed variation alone, the ECU 40 ends the routine.

If the present injection quantity correction is the integration value correction, S314 the ECU 40 determines whether the counter CT ranges between CT0 and CT1 (CT0≦CT≦CT1) at S314. In other words, it is determined whether the convergence time as a result of the present integration value correction is within a predetermined time range. If the counter CT ranges between CT0 and CT1 (CT0≦CT≦CT1), the ECU40 ends the routine.

At S316, the ECU 40 determines whether the counter CT does not range between CT0 and CT1 and further CT is larger than CT1 (CT>CT1). If CT is larger than CT1, the convergence time as a result of the integration value correction is longer than the predetermined time range. Thus, at S318, the ECU 40 makes the convergence coefficient K used at S302 smaller than the present coefficient K, and the smaller coefficient K is used for the next integration value correction.

When the convergence coefficient K is decreased, the formula (1) is satisfied with the difference between the rotational speed variations of the cylinders in which the explosion stroke is sequentially performed being smaller than the present injection quantity correction. Accordingly, in the next injection quantity correction, the integration value correction is carried out in a phase in which the difference between the rotational speed variations of the cylinders is smaller than the present correction. As a result, the variation in the rotational speed variations among the cylinders is promptly reduced.

If the predetermined value used by the determining means for its determination is decreased when the convergence time by carrying out the integration value correction is longer than the predetermined time range, the integration value is computed using an even smaller difference in the rotational speed variation as compared to the difference in the rotational speed variation between the cylinders when the predetermined value is large. As a result, even when the difference in the rotational speed variation between the cylinders is small, the integration of the rotational speed of each cylinder, which is equal to or larger than the predetermined rotational speed, is computed to correct the injection quantity. Thus, the convergence time becomes short.

If the counter CT does not range between CT0 and CT1 (CT0≦CT≦CT1) and is not larger than CT1 (CT>CT1) at S316, the counter CT is smaller than CT0 (CT<CT0). In such a case, the convergence time as a result of the integration value correction is shorter than the predetermined time range. Accordingly, the ECU 40 makes the convergence coefficient K used at S302 larger than the present coefficient K at S320, and the larger coefficient K is used for next integration value correction. The convergence time of the integration value correction is shorter than the predetermined time range, because it seems that the convergence time has been made unduly short as a result of performing the integration value correction even when the integration value correction is unnecessary.

Accordingly, by increasing the convergence coefficient K, the formula (1) is satisfied with the difference between the rotational speed variations of the cylinders in which the explosion stroke is sequentially performed being larger than the present injection quantity correction. As a result, in the next injection quantity correction, the integration value correction is not carried out unless the difference between the rotational speed variations of the cylinders is larger than the present correction. Consequently, the implementation of the integration value correction is prevented when the difference between the rotational speed variations of the cylinders is small, and thus the integration value correction is unnecessary. As a result, the processing load of the injection quantity correction is reduced.

When the convergence time is shorter than the predetermined time range, it seems that the integration value correction is carried out even when the integration value correction is unnecessary, and thereby the convergence time is made unduly short. Therefore, the determining means increases the predetermined value used for its determination. Accordingly, the integration value is computed when the difference in the rotational speed variation is even larger as compared to the difference in the rotational speed variation between the cylinders when the predetermined value is small. As a result, since the implementation of the integration value correction is prevented when the difference between the rotational speed variations of the cylinders is small and thus the integration value correction is unnecessary, the processing load of the injection quantity correction is reduced. After the convergence coefficient K is changed at S318 or S320, the ECU 40 ends the routine.

In the present embodiment described above, instead of the rotational speed variation of each cylinder which varies according to the size of the rotational speed variation of the immediately preceding cylinder, the injection quantity is corrected based on the integration value of the rotational speed that is equal to or more than the average rotational speed thereby to remove as much as possible the influence of the size of the rotational speed variation of the immediately preceding cylinder. Accordingly, the injection quantity is corrected with high precision, and thereby the variation in the rotational speed variations among the cylinders is promptly reduced within the predetermined range.

In the above manner, in the present embodiment, the injection quantity is corrected with high precision by carrying out the integration value correction, so that the variation in the rotational speed variations among the cylinders is promptly reduced within the predetermined range. Accordingly, the present embodiment is effective especially when learning the very small injection quantity.

In addition, in the present embodiment, the ECU 40 switches between the correction based on the integration value and the correction based on the rotational speed variation according to whether the formula (1) is satisfied at S302. Since the processing load is larger when calculating the integration value than when calculating the rotational speed variation, the processing load of the ECU 40 is reduced as much as possible by carrying out the integration value correction only when the difference between the rotational speed variations of the cylinders in which the explosion stroke is sequentially performed is large.

The processing load in computing the integration value on the rotational speed of each cylinder, which is equal to or larger than the predetermined rotational speed, is larger than the processing load in computing the rotational speed variation of each cylinder. Accordingly, by switching between the calculation of the integration value, and the calculation of the rotational speed variation of each cylinder whose processing load is smaller than the calculation of the integration value according to the difference in the rotational speed variation between the cylinders, the processing load needed to perform the correction of the injection quantity of the fuel injection valve 30 is reduced.

OTHER EMBODIMENTS

In the present embodiment, the ECU 40 switches between the correction based on the integration value and the correction based on the rotational speed variation according to whether the formula (1) is satisfied at S302. Alternatively, if the processing load when computing the integration value does not matter, the determination step of S302 may be omitted, and only the integration value correction may always be carried out.

If predetermined accuracy is ensured in computing the integration value, with the influence of the rotational speed variation of the immediately preceding cylinder being removed as much as possible, and the existence of the cylinder for which the integration calculation cannot be performed on the rotational speed because the maximum rotational speed does not reach the predetermined rotational speed being prevented, the boundary value of the rotational speed in calculating the integration value is not limited to the average value of the rotational speeds.

In the above embodiment, the convergence time is measured by the counter only when performing the integration value correction. Alternatively, the convergence time may be measured by the counter not only when performing the integration value correction but also when the injection quantity correction is carried out using the conventional rotational speed variation alone. Then, if the convergence time is beyond the predetermined time range, the convergence coefficient K in the formula (1) may be changed. More specifically, control may proceed from S304 to S308 in FIG. 3.

Moreover, regardless of the convergence time, the convergence coefficient K may be used as a constant value without changing the convergence coefficient K. In the above embodiment, the fuel injection system of the diesel engine is explained. In addition, when fuel is injected into each cylinder through corresponding one of fuel injection valves, the invention may be applied to, for example, a fuel injection system of a direct injection gasoline engine.

Functions of the plurality of means according to the invention are realized by hardware resources whose functions are specified by their configurations themselves, hardware resources whose functions are specified by a program, or their combinations. The functions of the plurality of means are not limited to those realized by the hardware resources, which are physically independent of each other.

In this manner, the invention is not limited to the above embodiment and may be applied to various embodiments without departing from the scope of the invention.

Additional advantages and modifications will readily occur to those skilled in the art. The invention in its broader terms is therefore not limited to the specific details, representative apparatus, and illustrative examples shown and described.

What is claimed is:

1. An injection quantity control unit for controlling an injection quantity of a plurality of fuel injection valves, respectively, wherein each of the plurality of fuel injection valves injects fuel into a corresponding one of cylinders of a multi-cylinder internal combustion engine, the unit comprising:

a rotational speed obtaining means for obtaining a rotational speed of the engine;

an integration value calculating means for calculating an integration value of the rotational speed, which is equal to or more than a predetermined rotational speed, in an explosion stroke of each of the cylinders; and a correcting means for correcting the injection quantity of the plurality of fuel injection valves based on the integration value of each of the cylinders so as to reduce variation in a rotational speed variation among the cylinders, wherein the rotational speed variation is a difference between a maximum rotational speed in the explosion stroke of each of the cylinders and a minimum rotational speed at a starting time of the explosion stroke of each of the cylinders.

2. The injection quantity control unit according to claim 1, wherein the predetermined rotational speed is an average rotational speed.

3. The injection quantity control unit according to claim 1, further comprising:

a rotational speed variation calculating means for calculating the rotational speed variation in the explosion stroke of each of the cylinders;

a difference calculating means for calculating a difference in the rotational speed variation between each two of the cylinders, in which the explosion stroke is performed consecutively; and a determining means for determining whether the difference in the rotational speed variation between each two of the cylinders is equal to or more than a predetermined value, wherein:

the integration value calculating means calculates the integration value of the rotational speed, which is equal to or more than the predetermined rotational speed, when the difference in the rotational speed variation between each two of the cylinders is equal to or more than the predetermined value with respect to at least one combination of two of the cylinders; and the correcting means corrects the injection quantity of the plurality of fuel injection valves based on the integration value when the difference in the rotational speed variation between each two of the cylinders is equal to or more than the predetermined value with respect to at least one combination of two of the cylinders, and corrects the injection quantity of the plurality of fuel injection valves based on the rotational speed variation of each of the cylinders when the difference in the rotational speed variation between each two of the cylinders is smaller than the predetermined value.

4. The injection quantity control unit according to claim 3, wherein:

the two of the cylinders, in which the explosion stroke is performed consecutively, include a first cylinder, in which the explosion stroke is first performed, and a second cylinder, in which the explosion stroke is performed after the explosion stroke in the first cylinder;

the determining means determines whether the following expression is satisfied:

$|\Delta NEn-\Delta NE(n+1)| \geqq \Delta NEavr \times K$, provided that:

ΔNEn is the rotational speed variation of the first cylinder;

ΔNE(n+1) is the rotational speed variation of the second cylinder;

ΔNEavr is an average value of the rotational speed variation among the cylinders;

K is a convergence coefficient, wherein K satisfies $0<K\leqq 1$; and the predetermined value is accordingly ΔNEavr×K; and the integration value calculating means calculates the integration value of the rotational speed, which is equal to or more than the predetermined rotational speed when the expression is satisfied.

5. The injection quantity control unit according to claim 3, wherein:

the variation in the rotational speed variation among the cylinders is reduced into a predetermined range, as a result of the correction of the injection quantity of the plurality of fuel injection valves based on the integration value by the correcting means;

the reduction of the variation in the rotational speed variation among the cylinders into the predetermined range takes a period of a convergence time;

the determining means decreases the predetermined value when the convergence time is longer than a predetermined time range, and the decreased predetermined value is used as the predetermined value in a next determination by the determining means; and the determining means increases the predetermined value when the convergence time is shorter than the predetermined time range, and the increased predetermined value is used as the predetermined value in the next determination by the determining means.

6. A fuel injection system comprising:

a high pressure pump that pressurizes and force-feeds fuel;

a common rail that accumulates fuel, which is force-fed by the high pressure pump;

a plurality of fuel injection valves, wherein each of the plurality of fuel injection valves injects fuel, which is accumulated by the common rail, into a corresponding one of cylinders of a multi-cylinder internal combustion engine; and the injection quantity control unit recited in claim 1.

* * * * *